US010513844B2

(12) United States Patent
Kasprzak et al.

(10) Patent No.: US 10,513,844 B2
(45) Date of Patent: Dec. 24, 2019

(54) BRACKET ANCHOR FOR FASTENING A FACING IN A SUPPORTING WALL, AND WEB PLATE OF A BRACKET ANCHOR

(71) Applicant: HALFEN GMBH, Langenfeld (DE)

(72) Inventors: Jaroslaw Kasprzak, Ostrow Wlkp (PL); Marcin Pilch, Kalisz (PL); Jerzy Staskiewicz, Ostrow Wlkp (PL); Dirk Albartus, Bochum (DE); Ertugrul Erzengin, Dormagen (DE); Caroline Piesker, Leichlingen (DE); Matthias Roik, Witten (DE); Michael Stegemann, Langenfeld (DE)

(73) Assignee: HALFEN GMBH, Langenfeld (DE)

( * ) Notice: Subject to any disclaimer, the term of this patent is extended or adjusted under 35 U.S.C. 154(b) by 0 days.

(21) Appl. No.: 15/487,773

(22) Filed: Apr. 14, 2017

(65) Prior Publication Data

US 2017/0306612 A1 Oct. 26, 2017

(30) Foreign Application Priority Data

Apr. 26, 2016 (EP) ..... 16167150

(51) Int. Cl.
*E04B 1/41* (2006.01)
*E04F 13/08* (2006.01)
(Continued)

(52) U.S. Cl.
CPC ..... *E04B 1/40* (2013.01); *E04F 13/075* (2013.01); *E04F 13/0832* (2013.01);
(Continued)

(58) Field of Classification Search
CPC ..... E04B 1/40; E04B 1/762; E04B 2001/405; E04B 2103/06; E04F 13/075; E04F 13/0832; E04F 13/0857
(Continued)

(56) References Cited

U.S. PATENT DOCUMENTS 1,271,210 A * 7/1918 Otte ..... E06B 1/34 52/211
1,787,038 A * 12/1930 Geoffray ..... F24D 19/02 248/233
(Continued)

FOREIGN PATENT DOCUMENTS

DE 8524910 U1 11/1985
DE 10149664 A1 * 6/2002 ..... E04F 13/0808
(Continued)

*Primary Examiner* — Patrick J Maestri
*Assistant Examiner* — Joseph J. Sadlon
(74) *Attorney, Agent, or Firm* — Lucas & Mercanti, LLP; Klaus P. Stoffel

(57) ABSTRACT

A bracket anchor for fastening a facing to a supporting wall has a bracket head for fastening the bracket anchor to the supporting wall, a web plate, a support element for supporting the facing, and a pressure element for transmitting pressure from the bracket anchor to the supporting wall. The support element and the pressure element are secured to the web plate. The entire web plate is formed from a single plate of constant wall thickness. The web plate includes a tension strut and a compression strut which are connected to one another only at their ends facing the support element and at most over half of the projecting length of the bracket anchor.

11 Claims, 7 Drawing Sheets

(51) Int. Cl.
*E04F 13/075* (2006.01)
*E04B 1/38* (2006.01)
*E04B 1/76* (2006.01)

(52) U.S. Cl.
CPC ..... *E04F 13/0857* (2013.01); *E04B 1/762* (2013.01); *E04B 2001/405* (2013.01); *E04B 2103/06* (2013.01)

(58) Field of Classification Search
USPC ..... 52/698; 248/500, 501
See application file for complete search history.

(56) References Cited

U.S. PATENT DOCUMENTS 2,780,936 A * 2/1957 Hillberg ..... E04B 1/4107 52/710
3,485,382 A * 12/1969 Larson ..... A47B 57/045 211/150
3,685,228 A * 8/1972 Pauley ..... E04B 2/94 52/235
3,972,168 A * 8/1976 Allen ..... E04B 1/4114 52/442
4,011,700 A * 3/1977 Sado ..... E06B 9/04 52/235
4,013,253 A * 3/1977 Perrault ..... A47B 96/061 248/222.51
4,071,216 A * 1/1978 Einhorn ..... A47B 96/061 248/282.1
4,079,556 A * 3/1978 Luck ..... E04G 21/26 52/127.2
4,094,415 A * 6/1978 Larson ..... A47F 5/0823 211/57.1
4,333,290 A * 6/1982 Koberstein ..... E04B 1/7612 52/309.2
4,479,338 A * 10/1984 Robertson ..... E04B 1/04 52/426
4,495,741 A * 1/1985 Pasiecznik ..... E04F 13/0807 52/404.1
4,510,010 A * 4/1985 Schramm ..... B31F 1/24 156/210
4,765,108 A * 8/1988 Lapish ..... E04B 1/41 248/231.91
5,063,721 A * 11/1991 Larsson ..... E04B 2/86 211/106
5,076,536 A * 12/1991 Fitzgerald ..... E01C 19/502 249/219.1
5,456,435 A * 10/1995 Sweeney ..... A47B 57/40 211/90.01
6,526,722 B1 * 3/2003 Pangburn ..... E04H 12/2292 256/35
6,588,169 B2 * 7/2003 Sarver ..... E04B 1/41 24/16 R
7,424,791 B2 * 9/2008 Johnson ..... E06B 1/363 248/208
7,533,501 B2 * 5/2009 Neal ..... E06B 1/36 52/204.54
8,186,645 B2 * 5/2012 Shaw ..... E04G 17/14 248/205.3
8,789,339 B2 * 7/2014 Di Scola ..... E04F 13/14 52/405.3
8,950,156 B2 * 2/2015 Vandehey ..... E04F 13/00 52/415
9,206,609 B2 * 12/2015 White ..... E04B 1/4107 52/710
10,119,267 B2 * 11/2018 Petzold ..... E04F 13/0801
10,273,681 B2 * 4/2019 Lammer-Klupazek ..... E04G 21/26 52/127.2
10,301,820 B2 * 5/2019 Browning ..... E04B 2/14
10,323,419 B2 * 6/2019 Hatzinikolas ..... E06B 1/36 52/204.54
2011/0185659 A1 8/2011 Lorenz

FOREIGN PATENT DOCUMENTS

DE 102004001209 A1 * 7/2005 ..... E04F 13/0857
DE 102004001209 A1 7/2005
DE 102009030635 A1 * 1/2011 ..... E04F 13/0808
DE 102010015262 A1 10/2011
DE 102010051557 A1 5/2012
FR 2924138 A1 * 5/2009 ..... E04F 13/0805
FR 2958956 A1 * 10/2011 ..... E04F 13/0857
FR 2958956 A1 10/2011

* cited by examiner

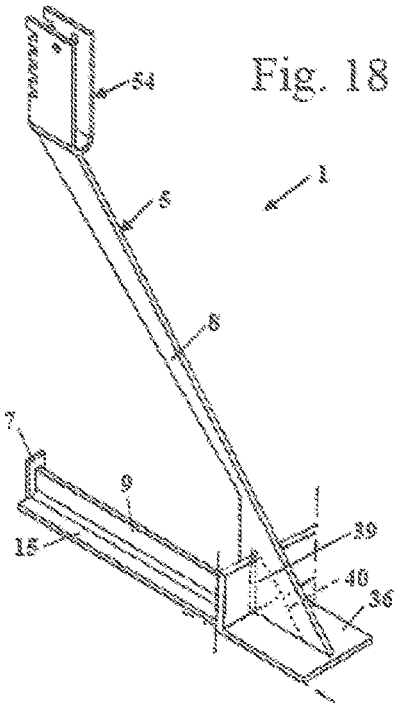
Fig. 18
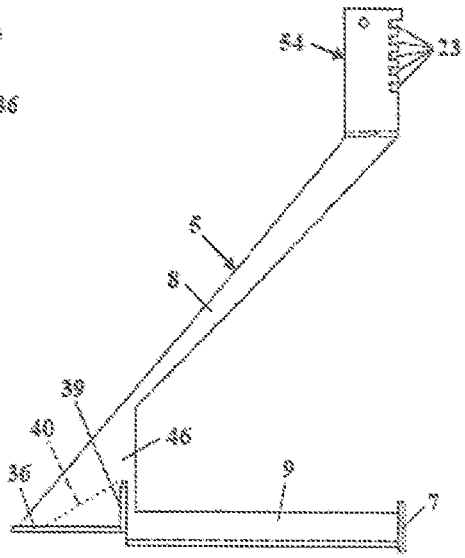
Fig. 19
Fig. 20
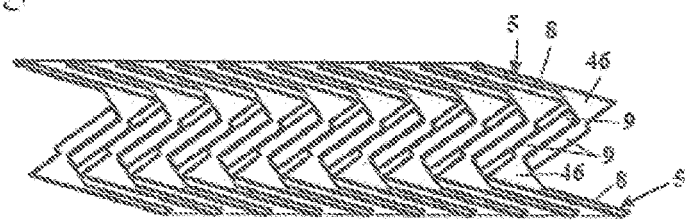

BRACKET ANCHOR FOR FASTENING A FACING IN A SUPPORTING WALL, AND WEB PLATE OF A BRACKET ANCHOR

CROSS-REFERENCE TO RELATED APPLICATIONS

The present application claims priority of EP 16 167 150.8, filed Apr. 26, 2016, the priority of this application is hereby claimed and this application is incorporated herein by reference.

BACKGROUND OF THE INVENTION

The invention relates to a bracket anchor for fastening a facing to a supporting wall and to a web plate for a bracket anchor.

DE 10 2010 051 557 A1 discloses a bracket anchor having a web plate which connects a bracket head, a support element and a pressure element to one another. The web plate is substantially triangular and has a circular opening for reducing thermal bridge losses.

DE 10 2010 015 262 A1 presents a bracket anchor in which a threaded sleeve is welded to the web plate, an adjusting screw being screwed into said threaded sleeve and serving to support the bracket anchor on the supporting wall. This results in the bracket anchor having a comparatively complicated structure. The compressive forces are absorbed by means of the adjusting screw.

SUMMARY OF THE INVENTION

The object on which the invention is based is to provide a bracket anchor of the generic type which is simple to produce and allows a low degree of heat transfer between supporting wall and facing. A further object of the invention is to specify a web plate of a bracket anchor which can be produced simply.

For the bracket anchor there is provision that the web plate comprises a tension strut and a compression strut which are connected to one another only at their ends facing the support element. Here, the connecting region, which connects the tension strut and the compression strut to one another at their ends facing the support element, extends at most over half the projecting length of the bracket anchor. The web plate is accordingly formed as an angle which is open toward the supporting wall. Given that the tension strut and the compression strut are connected to one another only at their ends facing the support element, the scrap obtained when producing the web plate from a plate can be minimized by suitably arranging a plurality of web plates on a plate to be cut up. The heat transfer is reduced at the same time. Additional thermally insulating elements between the bracket anchor and the supporting wall can thus advantageously be dispensed with. It has been shown that the vertical connection between bracket head and pressure element known from the prior art contributes only insignificantly, or not at all, to taking up the load. The load is predominantly taken up by the compression strut. By virtue of the fact that compression strut and tension strut are formed separately from one another in the region of the supporting wall, the cross sections of tension strut and compression strut are well adapted to the prevailing loading, with the result that only much less material is required for compression strut and tension strut. Consequently, the heat transfer between supporting wall and facing is minimized. The connecting region of tension strut and compression strut is arranged in the half of the bracket anchor that faces away from the supporting wall. As a result, the connecting region of tension strut and compression strut is situated partially, in particular completely, outside an insulation arranged between supporting wall and facing and does not contribute to the heat transfer between supporting wall and facing.

The connecting region advantageously extends at most over a third of the projecting length of the bracket anchor. The connecting region is preferably arranged substantially only in the region of the support element, that is to say in the region situated above and below the support element. The connecting region extends between the prolongation of the tension strut and the support element. The connecting region is advantageously designed to have a solid cross section with no cutout or interruption. As a result, the web plate is stabilized in the region remote from the supporting wall. At the same time, the free length of the compression strut, which is crucial for the bending behavior of the compression strut, is reduced. Support elements of different shape can be fixed to the connecting region, with the result that a web plate with connecting region is suitable for different design forms of bracket anchors. In order to achieve good fixing of a support element, in particular a support angle, it can be advantageous for the connecting region to have a cutout or a slot for receiving a portion of the support element.

The wall thickness of the web plate is advantageously less than 10 mm. The wall thickness of the web plate is preferably less than 8 mm. Using a comparatively thin plate minimizes the heat transfer between supporting wall and facing. The comparatively small wall thickness of the web plate gives rise to reduced stability by comparison with thicker web plates. This reduced stability can be compensated for by appropriately shaping the web plate. At the same time, the material consumption in the region of weld seams, in particular in the region of the connection of the bracket head, can be reduced on account of the smaller minimum length of the weld seams.

The tension strut has an outer edge facing away from the compression strut, and the compression strut has an outer edge facing away from the tension strut. The outer edges of tension strut and compression strut advantageously enclose, in a side view of the web plate, an angle of less than 60°. The angle between the outer edges of tension strut and compression strut is preferably from 30° to 60°.

The tension strut has an outer edge facing away from the compression strut and an inner edge facing the compression strut. The outer edge and the inner edge of the tension strut advantageously enclose, in a side view of the web plate, an angle of less than 20°. There can be provision that the outer edge and the inner edge of the tension strut extend parallel to one another. However, the width of the tension strut is preferably adapted to the forces and loading occurring in operation and changes between bracket head and connecting region. With particular preference, the angle opens toward the bracket head. Accordingly, the tension strut becomes narrower from the bracket head to the connecting region. However, there can also be provision that the tension strut widens from the bracket head toward the connecting region. The angle between the outer edge and the inner edge of the tension strut is preferably less than 10°. A particularly preferred configuration is obtained if the angle is between 1° and 5° and opens toward the bracket head.

In order to achieve a sufficient compressive strength of the compression strut in spite of the small thickness of the web plate, provision is advantageously made for the compression strut to have an angled-off portion. Here, the angling of the angled-off portion is provided in a cross section transversely with respect to the longitudinal direction of the compression strut, in particular perpendicularly to the longitudinal direction of the compression strut. The compression strut advantageously extends in an L shape in a cross section perpendicular to the longitudinal direction of the compression strut. However, another cross-sectional shape which increases the moment of inertia, such as, for example, a C-shaped or S-shaped cross section, can also be advantageous. The moment of inertia of the compression strut can be increased in a simple manner as a result of the angling. A solid compression member, such as, for example, a threaded rod or the like, can thus be dispensed with. By comparison with a solid threaded rod, a thin bent-off plate with the same moment of inertia has a reduced weight. At the same time, no additional component is required. Adaptation to the loads to be taken up can be achieved by suitably configuring the width of the angled-off portion. The angling also enables a pressure plate to be fixed to the compression strut in a simple manner.

The angled-off portion advantageously extends at least at the terminal side of the compression strut that faces away from the support element. The compression strut is connected to the pressure element at the terminal side. The compression element is preferably fixed, in particular welded, directly to the terminal side of the compression strut. The pressure element is advantageously a pressure plate. The support element is advantageously a support plate or a support angle. However, there can also be provision that the support element is an element suspended from the bracket anchor. Such a suspended support element can be connected to the web plate by means of sheet metal strips or the like, for example.

The bracket head advantageously engages around the web plate. As a result, the bracket head can be fixed to the web plate in a simple manner, for example by a welded connection. However, it can also be advantageous for the bracket head to have a closed underside which is fixed bluntly to the web plate, for example by a welded connection. The web plate is advantageously composed of stainless steel. Stainless steel has a lower thermal conductivity than structural steel or aluminum. Designing the web plate from stainless steel makes it possible, without the interposition of further separating layers, to achieve adequate reduction in the thermal bridges of the web plate.

A web plate for a bracket anchor is advantageously formed from a single plate of constant wall thickness and comprises a tension strut and a compression strut, wherein the tension strut and the compression strut are connected to one another only at the end which is intended for connection to a support element of the bracket anchor, wherein the connecting region of tension strut and compression strut extends at most over half a projecting length of the bracket anchor.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

BRIEF DESCRIPTION OF THE DRAWING

In the drawing:

FIG. 18 shows a schematic perspective illustration of the region of the bracket head of a further exemplary embodiment of a bracket anchor, FIG. 19 shows a side view of the bracket anchor from FIG. 18, and FIG. 20 shows a schematic illustration of the arrangement of a plurality of web plates on a plate.

DETAILED DESCRIPTION OF THE INVENTION

Figure 1:
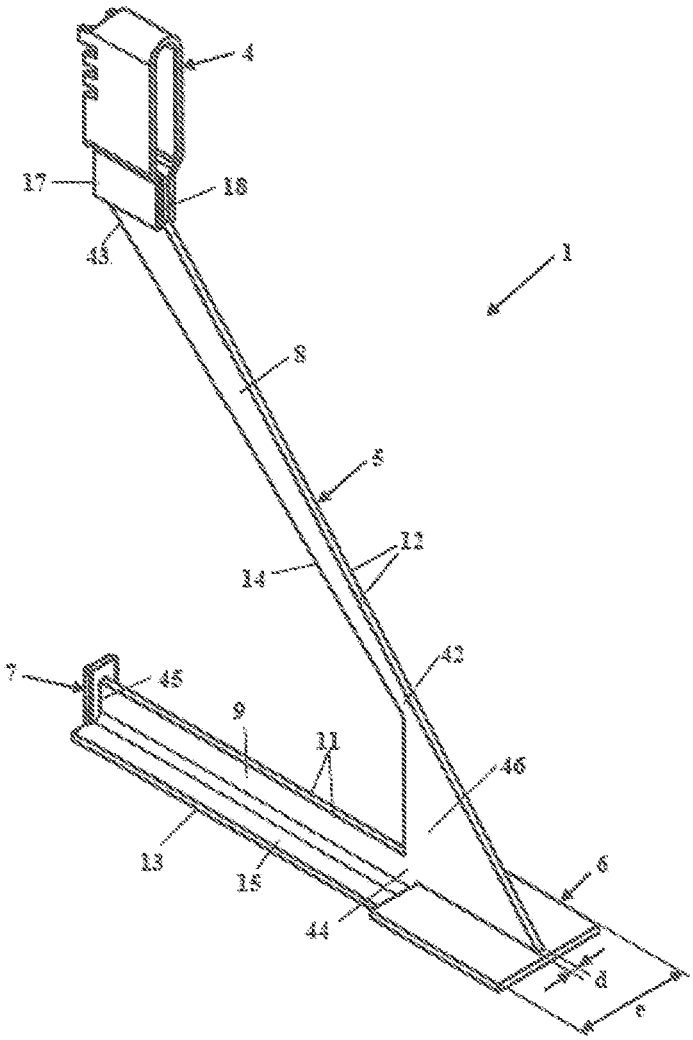
FIG. 1 shows a perspective illustration of a first exemplary embodiment of a bracket anchor.

FIG. 1 shows a bracket anchor 1 in a perspective illustration. The bracket anchor 1 is provided to support a facing on a supporting wall. Between the supporting wall and the facing there is usually arranged insulating material in order to keep heat transfer from the facing to the supporting wall as low as possible. The bracket anchor 1 has a bracket head 4 which is provided for fixing to a supporting wall. The bracket head 4 is fixed to a web plate 5. The web plate 5 comprises a tension strut 8 which extends obliquely downward from the bracket head 4 relative to a supporting wall, and a compression strut 9 which, after mounting on a supporting wall, is usually oriented approximately horizontally. The tension strut 8 and the compression strut 9 are connected to one another at a connecting region 46. In the exemplary embodiment, the connecting region 46 has an approximately triangular shape. A support element 6, in the exemplary embodiment a planar support plate, is arranged at the connecting region 46. The support element 6 is oriented horizontally and fixed to the underside of the connecting region 46, in particular by welding, by its side which is situated at the top in the mounting state. The tension strut 8 has a first end 42 which is arranged at the connecting region 46 and a second end 43 which is fixed to the bracket head 4. In the exemplary embodiment, the bracket head 4 has two portions 17 and 18 which are arranged on opposite sides of the second end 43 of the tension strut 8. The bracket head 4 thus engages around the web plate 5 in this region. The bracket head 4 is fixed to the web plate 5 at the portions 17 and 18, for example by welding. This is described in more detail hereinbelow. The compression strut 9 has a first end 44 which, in the exemplary embodiment, is arranged approximately vertically under the first end 42 of the tension strut 8. The compression strut 9 has a second end 45 which is to be arranged in the region of a supporting wall. At the second end 45 there is arranged a pressure element 7 which serves for supporting on the supporting wall 3. In the exemplary embodiment, the pressure element 7 is designed as a flat plate and bears directly against the supporting wall.

The web plate 5 is formed from a single plate with a constant wall thickness d. The web plate 5 can be cut out of a plate by laser cutting, for example. The wall thickness d of the web plate 5 is advantageously less than 10 mm, in particular less than 8 mm. A wall thickness d of less than 5 mm is considered to be particularly advantageous.

In order, in spite of the small wall thickness of the web plate 5, to achieve sufficient stability, in particular of the compression strut 9, and to prevent buckling of the compression strut 9 under load, provision is made for the compression strut 9 to have an angled-off portion 15. In the angled-off portion 15, the compression strut 9 is bent out of the plane of the tension strut 8. In the exemplary embodiment, the angled-off portion 15 is arranged on the side of the compression strut 9 that faces away from the tension strut 8 and extends over the entire length of the compression strut 9 from the connecting region 46 to the pressure element 7.

As FIG. 1 also shows, the tension strut 8 has two outer edges 12, which are the outer edges facing away from the compression strut 9, and two inner edges 14, of which only one is visible in FIG. 1 as a result of the perspective illustration. The outer edges 12 run parallel to one another. Likewise, the outer edges 14 run parallel to one another. The compression strut 9 has two inner edges 11 which run parallel to one another and which define the edges of the compression strut 9 that face the tension strut 8. The compression strut 9 additionally has an outer edge 13 on the angled-off portion 15, which outer edge is the edge facing away from the tension strut 8. The edge extending parallel to the outer edge 13 is closer to the tension strut 8. As FIG. 1 shows, the inner edges 11 of the compression strut 9 run parallel to the outer edge 13.

As FIG. 1 also shows, the support element 6 has a length e, measured in the horizontal direction, which is considerably greater than the wall thickness d of the web plate 5. The length e can advantageously be a few centimeters. A length e from about 2 cm to about 10 cm is considered to be advantageous. Here, the length e is measured in the horizontal direction along the supporting wall or the facing and perpendicular to the plane of the plate of the connecting region 46.

Figure 2:
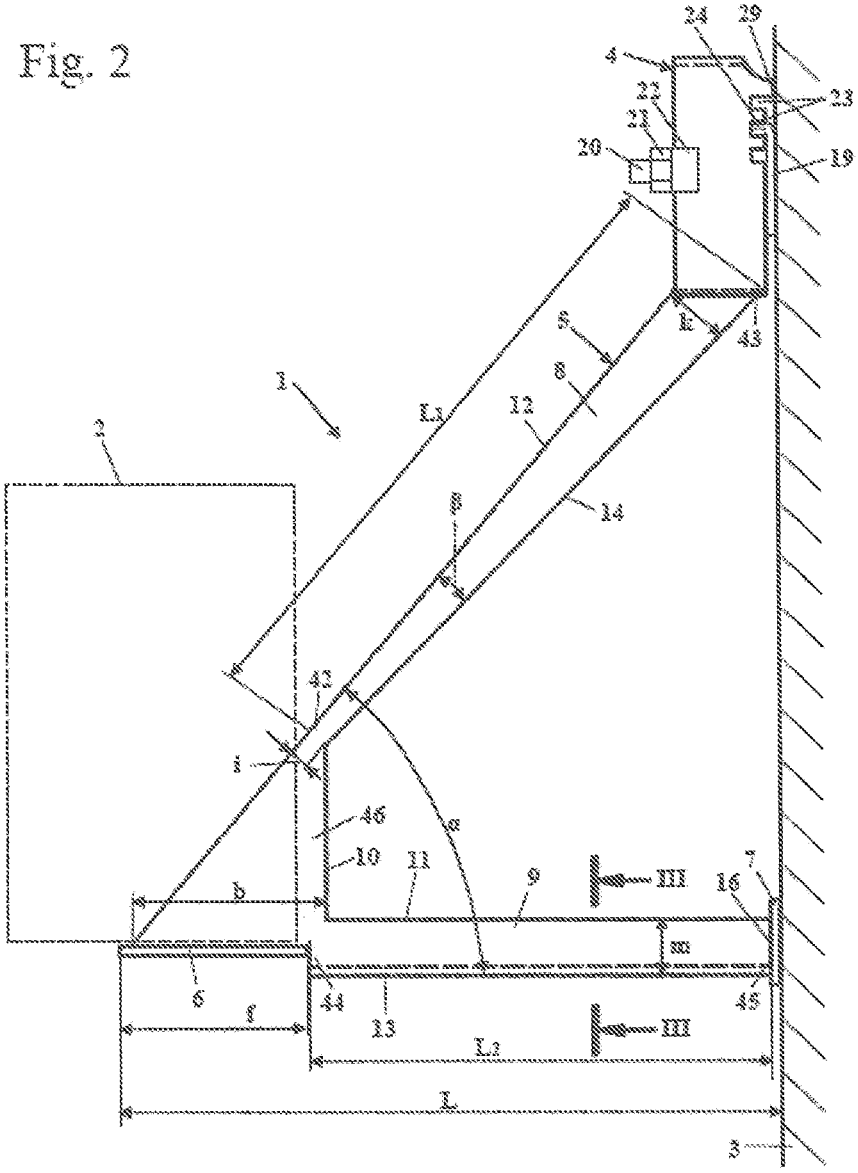
FIG. 2 shows a side view of the bracket anchor from FIG. 1 with a schematic illustration of supporting wall and facing.

FIG. 2 shows the arrangement of the bracket anchor 1 on a supporting wall 3. A facing 2 is also shown. Here, the facing 2 and the supporting wall 3 are only schematically illustrated. The bracket head 4 has a supporting portion 29 which is supported on the supporting wall 3. Here, the supporting portion 29 advantageously lies directly on the supporting wall 3. A fastening screw 20 is provided to fix the bracket anchor 4 to the supporting wall 3. The fastening screw 20 is advantageously an anchor head screw which projects into an anchor rail arranged in the supporting wall 3. Fixing takes place by means of a fastening nut 21 which presses against a U-plate 22 arranged on the bracket head 4. For height adjustment, the bracket head 4 has cutouts 23 on the side facing the supporting wall 3. In the exemplary embodiment, three cutouts 23 are provided. An obliquely perforated plate 19, which is described in more detail hereinbelow, is arranged between the bracket head 4 and the supporting wall 3 in the region of the fastening screw 20. The obliquely perforated plate 19 has a border 24 which juts from the supporting wall 3 and which projects into one of the cutouts 23.

The compression strut 9 has, at its second end 45, a terminal side 16 to which the pressure element 7 is fixed. The compression strut 9 has an L-shaped cross section at the terminal side 16 on account of the angled-off portion 15 (FIG. 1). The bracket anchor 1 is accordingly supported at the supporting portion 29 via the obliquely perforated plate 19 and at the pressure element 7 against the supporting wall 3. The web plate 5 has the shape of a bracket which is open to the supporting wall 3. The clearance formed between the tension strut 8 and the compression strut 9 is open toward the supporting wall 3. The pressure element 7 is also supported directly on the supporting wall 3. The interposition of further layers for thermal separation is advantageously not provided.

As FIG. 2 shows, the tension strut 8 has a length $L_1$ measured from its first end 42 to its second end 43. The compression strut 9 has a length $L_2$ measured from its first end 44 to its second end 45, this length being less than the length $L_1$. The outer edge 12 of the tension strut 8 encloses, with the inner edge 14 of the tension strut 8, an angle β. The angle β is advantageously less than 20°, in particular less than 10°. An angle β of 1° to 5° has proved particularly advantageous. However, there can also be provision that the angle β is 0° and the outer edge 12 and the inner edge 14 run parallel. In the exemplary embodiment, the angle β opens toward the bracket head 4. However, there can also be provision that the angle β opens toward the connecting region 46. The width of the tension strut 8 decreases on account of the angle β. At its first end 42, the tension strut 8 has a width i which is considerably less than a largest width k in the region of the second end 43. The width k is measured adjacent to the second end 43 in the region in which the tension strut 8 has its maximum width. The width k can advantageously be 1.5 times to 3 times the width i.

The outer edge 12 of the tension strut 8 encloses, with the outer edge 13 of the compression strut 9, an angle α which is advantageously less than 60°. The angle α is in particular from 30° to 40°, particularly advantageously from 40° to 50°. The bracket anchor 1 has a projecting length L. The projecting length L defines the overall length of the bracket anchor 1, that is to say the maximum extent measured perpendicular to the supporting wall 3. In the exemplary embodiment, the projecting length L is measured up to the side of the support element 6 that faces away from the supporting wall 3. The support element 6 has a width f measured perpendicular to the supporting wall 3, this width being less than half of, in particular less than a third of, the projecting length L. In the exemplary embodiment, the width f is about 20% to 30% of the projecting length L. In the exemplary embodiment, there is a small spacing between the support element 6 and the compression strut 9. The connecting region 46 has a length b which is measured in the plane of the web plate 5 and horizontally. The length b is thus measured perpendicular to the supporting wall 3. The length b is at most half the projecting length L. The length b is advantageously at most a third of the projecting length L. In the exemplary embodiment, the length b is between 20% and 30% of the projecting length L. In the exemplary embodiment, the connecting region 46 has an inner edge 10 which extends vertically. However, an inclined or curved profile of the inner edge 10 may also be advantageous. The inner edge 10 delimits the clearance enclosed between the tension strut 8 and the compression strut 9.

As FIG. 2 also shows, the compression strut 9 has a height m which is greater than the minimum width i of the tension strut 8. In the exemplary embodiment, the height m corresponds approximately to the largest width k of the tension strut 8. The height m of the compression strut 9 is measured in the vertical direction in the installed state.

As FIG. 2 shows, the facing 2, which can consist of bricks, for example, lies on the support element 6. In the exemplary embodiment, the facing 2 extends here only in the connecting region 46. However, there can also be provision that the facing 2 projects into the region of tension strut 8 and compression strut 9.

Figure 3:
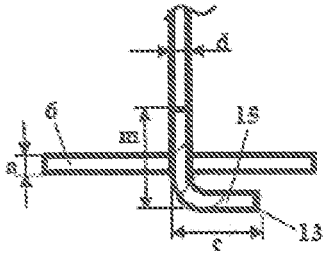
FIG. 3 shows a section along the line III-III in FIG. 2.

As FIG. 3 shows, the compression strut 9 has, in the angled-off portion 15, a width c which corresponds approximately to the height m. The width c can be suitably selected depending on the degree of the load to be taken up by the compression strut 9. The width c is advantageously about 0.5 times to 3 times the height m. The compression strut 9 has a constant height m and a constant width c over its entire length $L_2$. As FIG. 3 also shows, the support element 6 has, in the exemplary embodiment, a thickness a which advantageously corresponds to the wall thickness d of the web plate 5.

Figure 4:
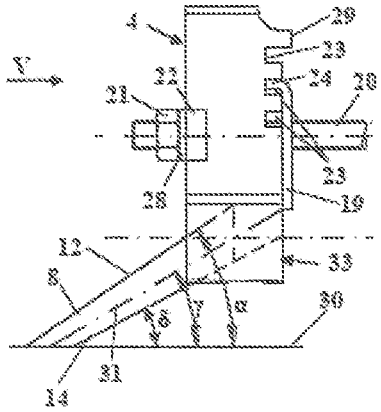
FIG. 4 shows, in the form of a detail, a side view of the region of the bracket head of the bracket anchor from FIGS. 1 and 2.
Figure 5:
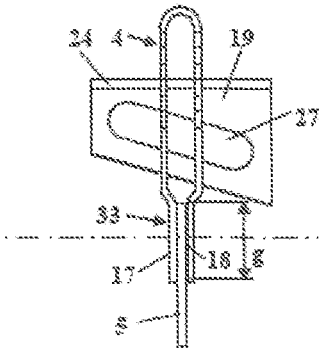
FIG. 5 shows a side view in the direction of the arrow V in FIG. 4.

FIGS. 4 to 7 show different designs of the bracket head 4. In FIGS. 4 and 5, the design of the bracket head 4 shown in FIGS. 1 and 2 is illustrated in detail.

The U-plate 22 shown in FIG. 4 engages around the bracket head 4 and offers a bearing surface for a washer 28 interposed between the U-plate 22 and the fastening nut 21. The fastening nut 21 can also bear directly against the U-plate 22.

FIG. 4 also shows the inclination of the tension strut 8 with respect to a horizontal 30. The horizontal 30 advantageously extends parallel to the compression strut 9 (FIG. 2). The outer edge 12 encloses, with the horizontal 30, the angle $\alpha$. In the exemplary embodiment according to FIG. 4, the angle $\alpha$ is less than in the exemplary embodiment according to FIGS. 1 to 3 and is less than 45°, in particular 30° to 45°. The angle $\alpha$ is advantageously from 30° to 60°. The inner edge 14 extends with respect to the horizontal 30 at an angle $\delta$ which is advantageously from 20° to 55°. The tension strut 8 has a longitudinal center axis 31 which is the angle bisector between the outer edge 12 and the inner edge 14. The longitudinal center axis 31 extends with respect to the horizontal 30 at an angle $\gamma$ which can advantageously be from 25° to 55°.

As FIG. 5 shows, the bracket head 4 is formed from a plate which is bent in an approximate U shape. Here, the legs of the U project downward, whereas the closed portion connecting the legs projects upward. The end regions of the legs of the U form portions 17 and 18 which are arranged on both sides of the web plate 5. The portions 17 and 18 overlap the web plate 5 in an overlapping region 33. In the exemplary embodiment according to FIGS. 4 and 5, the overlapping region 33 is comparatively large and has a height g measured in the vertical direction that is advantageously at least 1 cm. Consequently, the bracket head 4 can be fixed to the web plate 5 by means of resistance projection welding. Another fixing may also be advantageous.

FIG. 5 also shows the design of the obliquely perforated plate 19. The obliquely perforated plate 19 has an oblong hole 27 which extends at an inclination to the border 24. Laterally displacing the obliquely perforated plate 19 thus makes it possible to change the spacing between the border 24 and the region of the oblong hole 27 through which the screw 20 (FIG. 4) extends. Fine adjustment of the mounting height of the bracket head 4 is thus possible.

Figure 6:
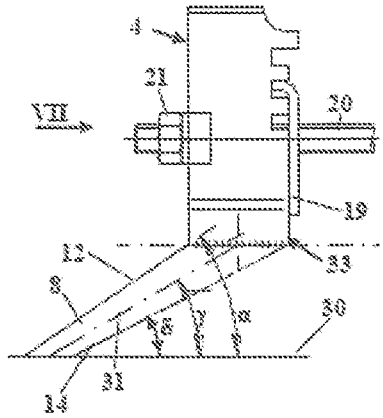
FIG. 6 shows, in the form of a detail, a side view of an exemplary embodiment of the region of the bracket head of a bracket anchor.
Figure 7:
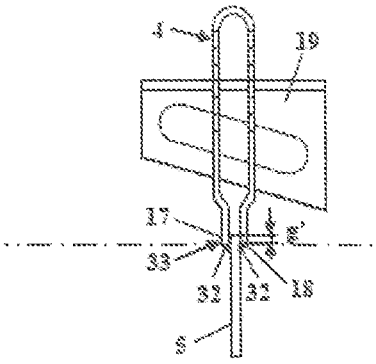
FIG. 7 shows a side view in the direction of the arrow VII in FIG. 6.

FIGS. 6 and 7 show a further exemplary embodiment for attaching the bracket head 4 to the web plate 5. In the exemplary embodiment according to FIGS. 6 and 7, the bracket head 4 is connected to the web plate 5 via portions 17 and 18 which are of considerably shorter design than in the exemplary embodiment shown in FIGS. 4 and 5. The overlapping region 33 has a height g' which is comparatively small and can be from about 3 mm to 10 mm. The height g' can lie in the range of the wall thickness d (FIG. 1) of the web plate 5. On each of the portions 17 and 18 there is arranged a weld seam 32 which takes the form of a fillet seam. The further design of the bracket head 4 and of the web plate 5 corresponds to the design described for the preceding exemplary embodiment. Here, identical reference signs designate mutually corresponding elements in all exemplary embodiments.

Figure 8:
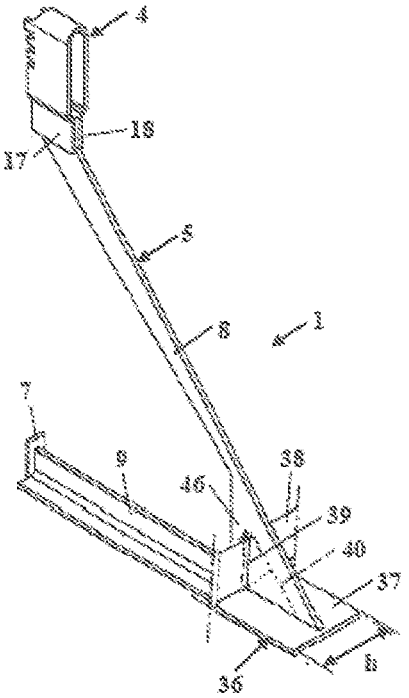
FIG. 8 shows a perspective schematic illustration of an exemplary embodiment of a bracket anchor.
Figure 9:
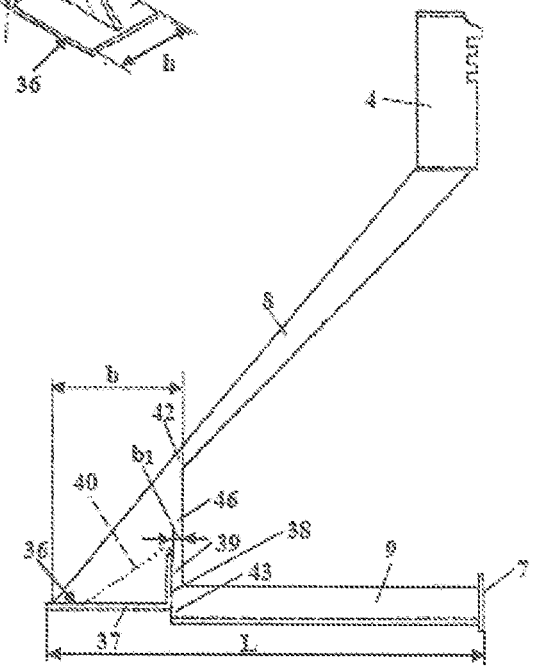
FIG. 9 shows a schematic side view of the bracket anchor from FIG. 8.

FIGS. 8 and 9 show an exemplary embodiment of a bracket anchor 1 which, instead of the support element 6, has a support element 36. The support element 36 is designed as a support angle and has a support portion 37 and a bearing portion 38 extending at an angle thereto. In the exemplary embodiment, the support portion 37 and the bearing portion 38 extend at an angle of 90°, with the bearing portion 38 being oriented vertically and the support portion 37 horizontally. The connecting portion 46 has a slot 39 through which the bearing portion 38 projects. Alternatively, there can be provision that the connecting portion 46 has a cutout 40, which is shown using a dotted line in FIGS. 8 and 9. The cutout 40 can advantageously have an approximately triangular shape. The support element 36 has a length h measured parallel to the supporting wall 3 and in the horizontal direction, which length can be considerably greater than the length e of the support element 6. The length h is advantageously from about 10 cm to about 30 cm. There can also be provision that a plurality of web plates 5 with bracket heads 4 and pressure elements 7 are arranged on a support element 36. In this case, the length h of the support element 36 can also be considerably greater.

In the exemplary embodiment according to FIGS. 8 and 9, too, the connecting region 46 is provided to connect tension strut 8 and compression strut 9 at their ends 42 and 43. On account of the cutout 40 or the slot 39, the length $b_1$ of the connecting region 46 at its narrowest point is very small and is only a fraction of the projecting length L. In the exemplary embodiment, the minimum length $b_1$ of the connecting region 46 is less than a tenth of the projecting length L. However, the total length b of the connecting region 46, that is to say the region via which the tension strut 8 and the compression strut 9 are connected to one another, is considerably greater and is about 20% to 30% of the projecting length L. The length b is less than half the projecting length L of the bracket anchor 1.

Figure 10:
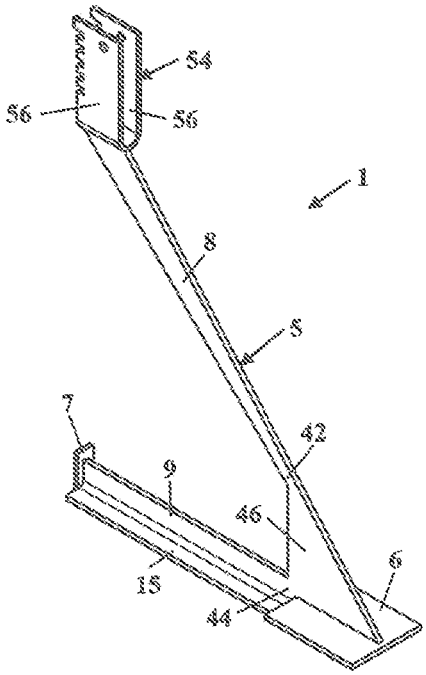
FIG. 10 shows a perspective illustration of a further exemplary embodiment of a bracket anchor.
Figure 11:
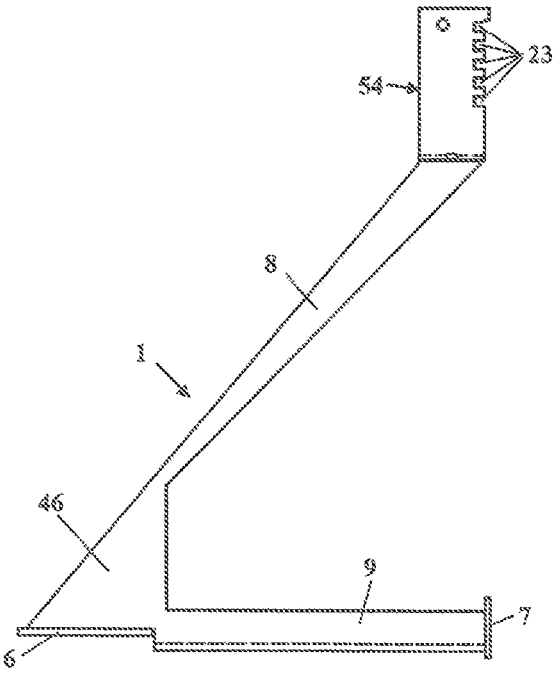
FIG. 11 shows a side view of the bracket anchor from FIG. 10.

FIGS. 10 and 11 show an exemplary embodiment of a bracket anchor 1 of which the structure corresponds substantially to the bracket anchor 1 shown in FIGS. 1 and 2. The bracket anchor 1 shown in FIGS. 10 and 11 differs from the bracket anchor 1 according to FIGS. 1 and 2 in terms of its bracket head 54. The bracket head 54 is U-shaped and has two legs 56 which project upward. The legs 56 are connected to one another at the region facing the web plate 5. As FIGS. 10 and 11 show, the bracket head 54 has a total of five cutouts 23. A height adjustment over a greater range is thus possible. A different number of cutouts 23 can also be advantageous for a bracket head 54.

Figure 12:
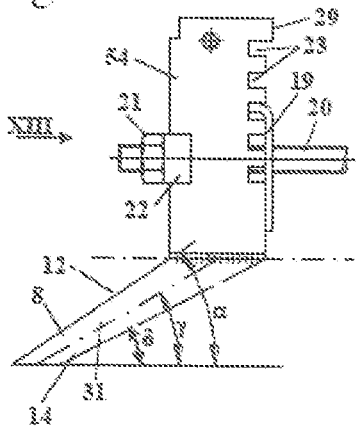
FIG. 12 shows, in the form of a detail, a side view of the region of the bracket head of the bracket anchor from FIGS. 10 and 11.
Figure 13:
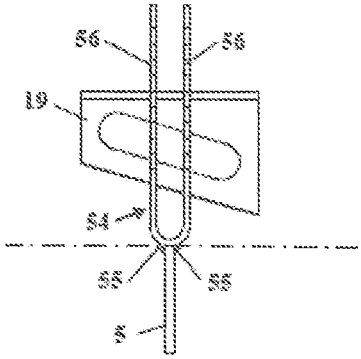
FIG. 13 shows a side view in the direction of the arrow XIII in FIG. 12.

FIGS. 12 and 13 show the design of the bracket head 54 in detail. Fixing the bracket head 54 by means of the obliquely perforated plate 19 and the fastening screw 20 corresponds to the design in the exemplary embodiment according to FIGS. 4 and 5. The design of the tension strut 8 of the web plate 5 also corresponds to the design from FIGS. 4 and 5. As FIGS. 12 and 13 show, the bracket head 54 has no overlapping region with the web plate 5. The web plate 5 bears bluntly by its terminal side against the bracket head 54 and is welded to the web plate 5 by means of two weld seams 55 which takes the form of fillet seams.

Figure 14:
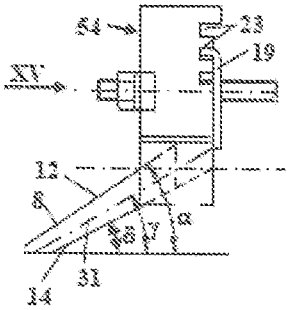
FIG. 14 shows, in the form of a detail, a side view of the region of the bracket head of an exemplary embodiment of a bracket anchor.
Figure 15:
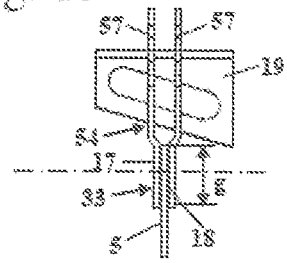
FIG. 15 shows a side view in the direction of the arrow XV in FIG. 14.

In the exemplary embodiment of the bracket head 54 shown in FIGS. 14 and 15, the bracket head 54 is made up of two side walls 57. One of the side walls 57 forms the portion 17, and the other of the side walls 57 forms the portion 18 arranged on the opposite side of the web plate 5. The portions 17 and 18 overlap the web plate 5 in an overlapping region 33 which has a comparatively large height g. The side walls 57 are connected to the web plate 5 in the overlapping region 33 by a welded connection, advantageously by resistance projection welding.

Figure 16:
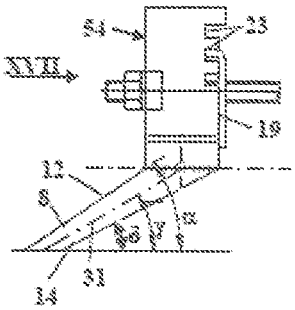
FIG. 16 shows, in the form of a detail, a side view of the region of the bracket head of a further exemplary embodiment of a bracket anchor.
Figure 17:
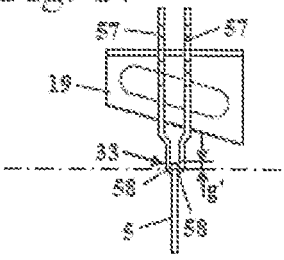
FIG. 17 shows a side view in the direction of the arrow XVII in FIG. 16.

In the exemplary embodiment of a bracket head 54 shown in FIGS. 16 and 17, there are likewise provided two side walls 57 which bear against the web plate 5 on opposite sides of the web plate 5. The side walls 57 overlap the web plate 5 in an overlapping region 33 of which the height g' is very small. Weld seams 58 which take the form of fillet seams are provided to connect the side walls 57 to the web plate 5.

The bracket heads 54 shown in FIGS. 14 to 17 each have only three cutouts 23 in the exemplary embodiment. The number of cutouts 23 can be selected according to the desired maximum possible height adaptation of the position of the bracket anchor 1 of a supporting wall 3.

FIGS. 18 and 19 show an exemplary embodiment of a bracket anchor 1 which has a bracket head 54 and a support element 36. The support element 36 is arranged in a slot 39 or a cutout 40 of the connecting region 46. The further design of the bracket anchor 1 shown in FIGS. 18 and 19 corresponds to the design described for the preceding exemplary embodiments.

FIG. 20 schematically shows the arrangement of the outlines of a plurality of web plates 5 on a plate from which the web plates 5 are to be cut out. As FIG. 20 shows, the compression struts 9 each lie adjacent to one another, whereas the tension struts 8 project outward on alternate sides. Here, the web plates 5 of compression struts 9 situated next to one another are arranged so as to be rotated through 180° with respect to one another. The second end 45 of each compression strut 9 projects up to the connecting region 46 of an adjacent web plate 5. A space-saving arrangement is thereby achieved, resulting in very little material scrap. The web plates are advantageously cut out from the plate by laser cutting. The angled-off portion 15 can then be angled off from the blank of the compression strut 9, and the bracket head 4, 54, the support element 6, 36 and the pressure plate 7 can be fixed to the web plate 5, in particular by welding. A very simple production in few production steps is thus made possible. The web plate 5 is advantageously made of stainless steel. However, a different arrangement of the outlines of the web plates 5 on a plate from which the web plates 5 are to be cut out may also be advantageous.

While specific embodiments of the invention have been shown and described in detail to illustrate the inventive principles, it will be understood that the invention may be embodied otherwise without departing from such principles.

We claim:

1. A bracket anchor for fastening a facing to a supporting wall, wherein the bracket anchor comprises: a bracket head for fastening the bracket anchor to the supporting wall; a web plate; a support element for supporting the facing; and a pressure element for transmitting pressure from the bracket anchor to the supporting wall, wherein the support element and the pressure element are secured to the web plate, wherein the entire web plate is formed from a single plate of constant wall thickness, wherein the web plate comprises a tension strut and a compression strut, the tension strut and the compression strut being connected to one another only in a connecting region at ends of the tension strut and the compression strut facing the support element, wherein the connecting region extends at most over half a projecting length of the bracket anchor, wherein the compression strut has an angled-off portion, wherein the angled-off portion is angled in a cross section transversely with respect to a longitudinal direction of the compression strut, wherein the angled-off portion extends at least along a terminal side of the compression strut that faces away from the support element, and the compression strut is connected to the pressure element at the terminal side.

2. The bracket anchor according to claim 1, wherein the connecting region extends at most over a third of the projecting length of the bracket anchor.

3. The bracket anchor according to claim 1, wherein the connecting region extends between the tension strut and the support element.

4. The bracket anchor according to claim 1, wherein the wall thickness of the web plate is less than 10 mm.

5. The bracket anchor according to claim 1, wherein the tension strut has an outer edge facing away from the compression strut, and the compression strut has an outer edge facing away from the tension strut, wherein the outer edges enclose, in a side view of the web plate, an angle of less than 60°.

6. The bracket anchor according to claim 1, wherein the tension strut has an outer edge facing away from the compression strut and an inner edge facing the compression strut, the outer edge and the inner edge of the tension strut enclose, in a side view of the web plate, an angle of less than 20° and the angle opens toward the bracket head.

7. The bracket anchor according to claim 6, wherein the angle enclosed by the outer edge and the inner edge of the tension strut is less than 10°.

8. The bracket anchor according to claim 1, wherein the pressure element is a pressure plate.

9. The bracket anchor according to claim 1, wherein the support element is a support plate or a support angle.

10. The bracket anchor according to claim 1, wherein the bracket head engages around the web plate.

11. The bracket anchor according to claim 1, wherein the web plate is made of stainless steel.

* * * * *